US006668882B1

(12) United States Patent
Cazes

(10) Patent No.: US 6,668,882 B1
(45) Date of Patent: Dec. 30, 2003

(54) HANDBAG WITH REMOVABLE PURSE

(76) Inventor: Catherine Cazes, 121 Oak St., #C, Paso Robles, CA (US) 93446

( * ) Notice: Subject to any disclaimer, the term of this patent is extended or adjusted under 35 U.S.C. 154(b) by 0 days.

(21) Appl. No.: 10/172,583

(22) Filed: Jun. 14, 2002

(51) Int. Cl.[7] ..... A45C 13/08
(52) U.S. Cl. ..... 150/104; 150/113; 190/110
(58) Field of Search ..... 150/104, 106, 150/102, 103, 112, 113, 114; 190/101, 102, 110, 902

(56) References Cited

U.S. PATENT DOCUMENTS

| | | | | | |
|---|---|---|---|---|---|
| 1,612,342 | A | * | 12/1926 | Alstrand | 150/113 |
| 1,622,306 | A | * | 3/1927 | Borfuss | 150/117 |
| 2,055,569 | A | * | 9/1936 | Zolotow | 150/113 |
| 2,130,502 | A | | 9/1938 | Lindemann | |
| 4,050,493 | A | * | 9/1977 | Cho | 150/106 |
| D246,939 | S | | 1/1978 | Casser | D87/3 |
| 4,250,938 | A | | 2/1981 | Siegel | 150/35 |
| 4,995,436 | A | | 2/1991 | Cantor | 150/102 |
| 5,197,525 | A | * | 3/1993 | Cantor | 150/102 |
| 5,944,155 | A | | 8/1999 | Geary | 190/108 |
| 6,174,082 | B1 | * | 1/2001 | Pelky et al. | 383/22 |
| 6,502,742 | B1 | * | 1/2003 | Su | 229/67.3 |

FOREIGN PATENT DOCUMENTS

WO WO 99/13749 3/1999

OTHER PUBLICATIONS

Godshaw, Pub. US 2002/0195304, Dec. 26, 2002.*
Seamon, Pub. US 2002/0121322, Sep. 5, 2002.*
Varnali, Tereza, Dr., "What is Leather?", Bogazici University, Department of Chemistry, Istanbul, Turkey (Mar. 31, 2002).
*The Leatherworking Handbook*, "Moulding and Surface Decoration," pp. 72–74 and 100–104.

* cited by examiner

*Primary Examiner*—Nathan J. Newhouse
*Assistant Examiner*—Lien Ngo
(74) *Attorney, Agent, or Firm*—Coudert Brothers LLP

(57) ABSTRACT

The present invention provides a handbag having a recess or similar depression molded in a back panel for holding a purse. A shoulder strap is provided for carrying the handbag with the back panel and the recess adjacent to the user's body so the purse is inaccessible to all but the user. The recess is sized to firmly fit the purse with the front of the purse being substantially flush with outer face of the back panel. The handbag is also provided with a back flap to complete cover the recess and the purse to make the purse even more inaccessible to non-users. Velcro or similar type of a fastener holds the back flap firmly to the back panel. At least the back panel of the handbag is made of a type of leather in which the recess is molded into back panel using warm water and a molding press. The back panel consists of two separate molded pieces of leather whose rough sides are joined by an adhesive and whose smooth sides are the outer and inner faces of the back panel. A liner is sewn to the inner face of the back panel to form inner pockets.

22 Claims, 2 Drawing Sheets

HANDBAG WITH REMOVABLE PURSE

FIELD OF INVENTION

The present invention relates to a handbag having a removable purse. More particularly the invention relates to a handbag in which the removable purse is readily accessible to the user, but inaccessible to all others.

BACKGROUND OF THE INVENTION

A lady's handbag is known that has multiple compartments built within a side panel and readily accessible to the user; see U.S. Pat. No. 2,130,502. None of these compartments are removable from the handbag. Other handbags in the prior art have removable purses; see U.S. Pat. Nos. 4,250,938 and Des. 246,939. Each of these prior art removable purses is visible to others making them easy targets for theft.

There is increased need for a handbag with a removable purse that enables users to have immediate access to their identification and credit cards at security checkpoints of airports, bus terminals, train stations and the like. There is also a need for such a handbag in which the removable purse is readily assessable only to the user, i.e., a purse that is hidden from others that may be tempted to unlawfully remove the purse from the user's handbag.

SUMMARY OF THE INVENTION

The present invention fulfills the need for a handbag having a removable purse that is readily accessible only to the user. The present invention comprises a handbag having a recess or similar depression in a back panel for firmly holding the purse. The handbag is designed to be carried with the recess adjacent to the user's body and inaccessible to all but the user.

More particularly, the handbag of the present invention comprises a front panel, a back panel, two side panels, a top opening, a bottom panel, and having the recess for receiving the purse that is molded within the back panel.

In a preferred embodiment, a closure flap covers the top opening, and a back flap covers the recess and the purse, if it is held within the recess. The latter feature makes the purse even more inaccessible to non-users. In this preferred embodiment, the back flap is held firmly to the back panel by means of snaps, Velcro® hook and loop fasteners or other similar means of attachment. This arrangement allows the user to reach a hand under the back flap and force apart a portion of the fasteners to easily retrieve the purse from the recess and to return the purse to the recess. The recess is designed to provide a snug fit for the purse. Therefore, no additional attachment means are required between the purse and back panel. Preferably, such attachments means are used to prevent any possibility of the purse becoming dislodged from the recess and lost.

BRIEF DESCRIPTION OF THE DRAWINGS

Further features and advantages will become apparent from the following and more particular description of the preferred embodiment of the invention, as illustrated in the accompanying drawing in which.

DETAILED DESCRIPTION OF THE PREFERRED EMBODIMENT

Figure 7:
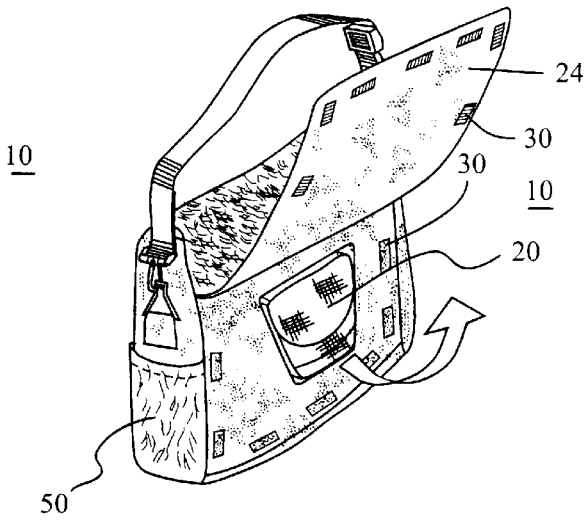
FIG. 7 is a top, left side and back perspective view the embodiment of the present invention shown in FIG. 1, in which a back flap is raised and the purse is within the recess.

FIGS. 1–7 are illustrative of a typical configuration of one embodiment of the present invention. In this embodiment, handbag 10 has back panel 12 with recess 18 for receiving purse 20. Recess 18 is molded in back panel 12 by a process described in the Example below. Recess 18 is sized to firmly fit purse 20 and so that the front of the purse is substantially flush with outer face of back panel 12 as shown in FIG. 7. Although purse 20 fits firmly within recess 18, fasteners are included to attach purse 20 in the handbag of the preferred embodiment. The dimensions of purse 20 are not critical and can be modified to accommodate a cell phone or other items.

Back flap 24 is affixed adjacent closure flap 28 that is at the top of back panel 12. Velcro hooks and loop fasteners 30 are respectively attached to back panel 12 and to back flap 24 adjacent left side panel 32, right side panel 34 and bottom panel 36 of handbag 10. Similar fasteners 38 are respectively attached to the recess and the back of purse to provide added protection so that the purse is not dislodged from recess.

Closure flap 28 extends from a fraction of the length of back panel 12 below opening 40 in the top of handbag 10 and covers approximately two thirds of front panel 44. Decorative tassel 48 is attached to closure flap 28 as shown. Magnetic snap 49 or other fastener is used between front panel 44 and closure flap 28 behind tassel 48 to secure flap 28 to panel 44.

Outer pocket 50 is shown on left side panel 32. It is formed by affixing a piece of material to the lower portion of left side 32 between front panel 44 and back panel 12 as shown. The choice of sides for pocket 50 is not critical and pockets can be included on both sides. In this embodiment, the pocket is sized to fit standard cell phone 54, shown in phantom in FIG. 1. This size ranges from about 2 to 2 ½ inches wide by 4 to 5 inches long and ½ to 1 inch thick.

Shoulder webbing 60 having adjustment clasp 64 is secured to left side 32 and right side 34 by conventional hardware. In the embodiment shown, each end of webbing 60 is looped through plastic triangles 66 fixedly attached to the respective sides by means of patches 68. Any similar type of shoulder strap and hardware that is used on handbags may be used with the handbag of the present invention.

Figure 1:
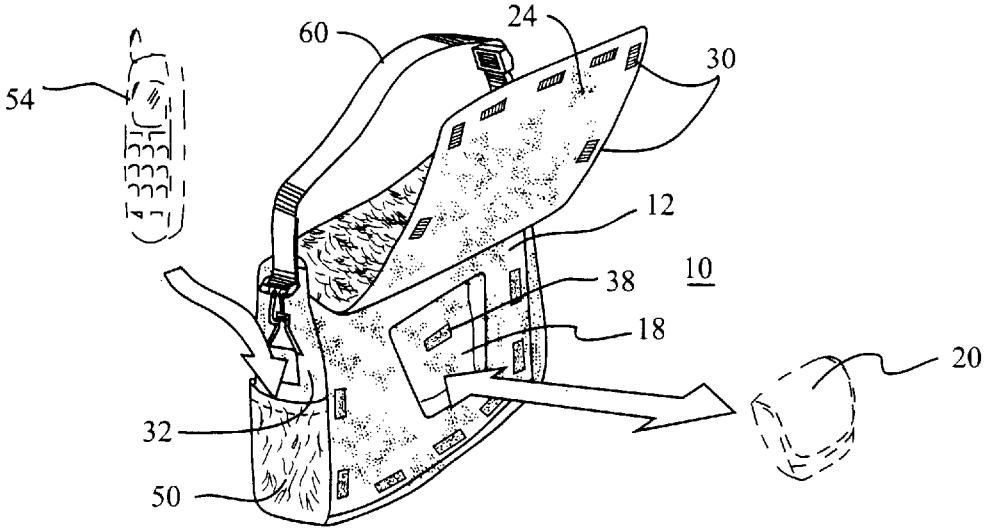
FIG. 1 is a top, left side and back perspective view of one embodiment of the handbag of the present invention, in which the back flap is raised and the removable purse is being removed from the recess in the back panel.
Figure 2:
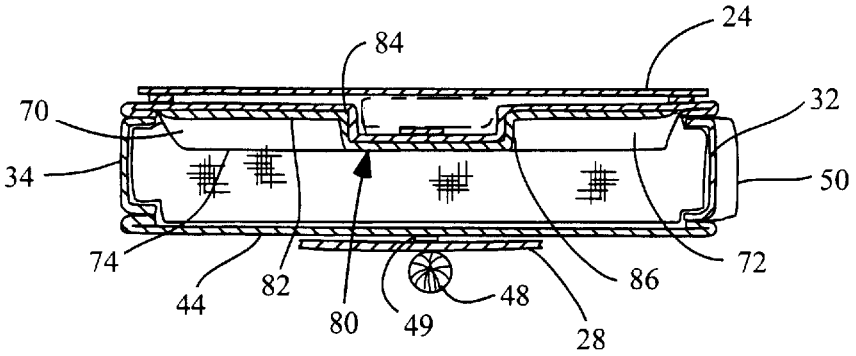
FIG. 2 is a sectional view of the embodiment shown in FIG. 1 taken along line 2—2 of FIG.6.
Figure 3:
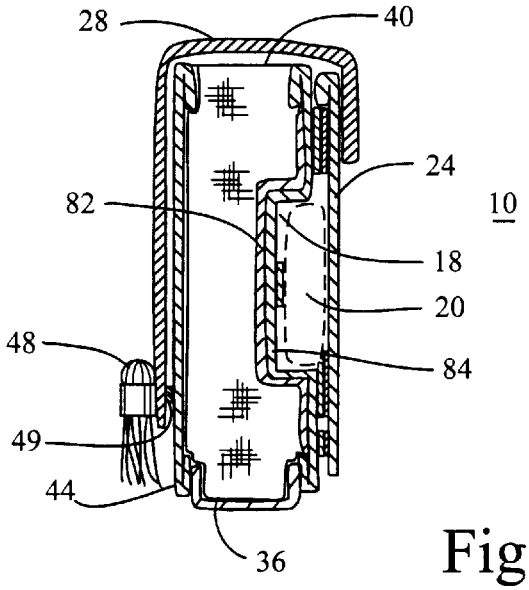
FIG. 3 is a sectional view of the embodiment shown in FIG. 1 taken along line 3—3 of FIG. 6.
Figure 4:
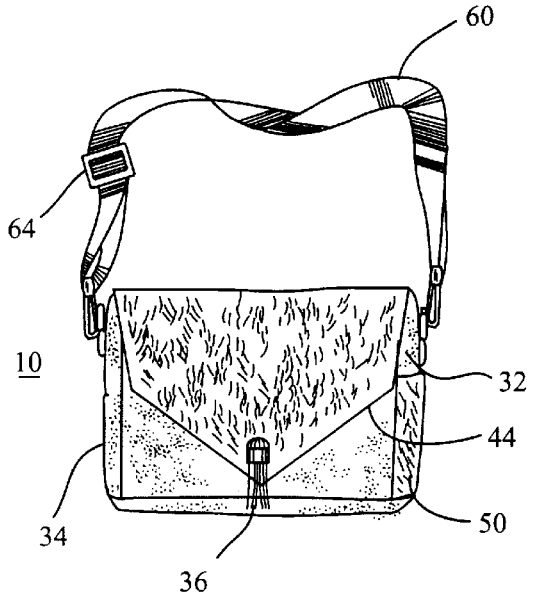
FIG. 4 is front perspective view of the embodiment of the present invention shown in FIG. 1.
Figure 5:
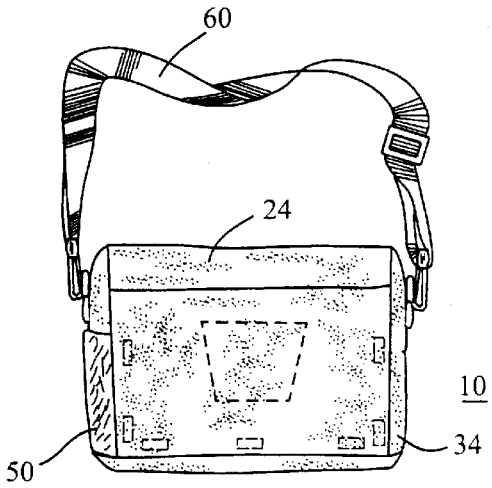
FIG. 5 is back perspective view of the embodiment of the present invention shown in FIG. 1.
Figure 6:
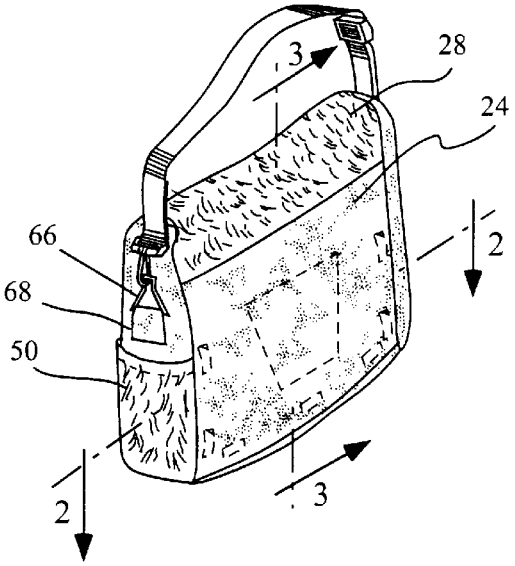
FIG. 6 is a top, left side and back perspective view the embodiment of the present invention shown in FIG. 1, in which the back flap is fastened to the back panel.

In the preferred embodiment shown in FIG. 2, inner pockets 70 and 72 are formed within handbag 10. Pockets 70 and 72 are positioned on each side of recess 18 and extend the entire depth of handbag 10. Inner liner 74 is sewn in the manner described in the Example below to form the pockets. If liner 74 were not used, protuberance 80 created by recess 18 would make if difficult for the user to find items placed within handbag 10. The pockets serve as a place to store sunglasses, and reading and other eyeglasses, a wallet, make-up or similar items.

The overall dimensions of handbag 10 are not critical. However, it is contemplated that handbags that can accommodate with either standard paper or legal size documents have great utility. The handbag can be made of a variety of materials. However, it has been found that to form the completely seamless recess into the back panel, at least the back panel must consist of moldable leather. One such leather that has been found to be particularly effective is vegetable tanned leather.

The example that follows illustrates the best mode of a process for making a handbag with a completely seamless recess molded into back panel 12, which comprises inner piece 82 and outer piece 84. The example is for illustrative purposes only and is not meant to limit the scope of the claims in any way.

EXAMPLE

The first step in the recess forming process was to cut vegetable tanned, tumbled black leather into pieces of about 10 inches by 12½ inches to accommodate standard paper plus the additional material necessary to accommodate the stitches and seams. Each piece ranges from 1¼ to 2¼ oz in thickness. A clicker press, e.g., a manual clicker sold by Multiforce, was used to cut the leather into each of these pieces with a die of the proper dimensions.

The second step was to submerge the leather pieces into very warm water, i.e. temperatures of at least 90° F. and preferably about 125° F., for at least two minutes or for at least a period of time that allowed the bubbles that form around the leather pieces to come to the surface of the water The third step was to place each leather piece in a separate molding press. The molding press has an outer block of approximately 10 inches square and an inner block with the exact outer dimensions of the recess. In this Example, the inner block was in the shape of a trapezoidal figure having a height of 4¾ inches, a base width of 3⅜ inches, a top width of 5¼ inches, and a thickness of 1¼ inches. Purse 20 was made as shown having substantially the same as dimensions as the trapezoidal figure. The molding press was placed in the center of a 16-inch by 16-inch square tray. A stapling frame was placed around the entire periphery of the tray.

The fourth step was to place the wet, warmed piece under the inner block using care to make sure the block was correctly oriented. The edges of the leather were held firmly, e.g. using pliers, as the block was pressed into the leather piece mounted over the cavity of the molding press. Simultaneous to pressing the block, the edges of the leather piece were stapled into the stapling frame. Sometimes, because of the elasticity properties of leather, it was necessary to begin pressing the block into only one corner of the piece and then the wrinkles that would form were worked out at the opposite corner of the piece. The stretching step continued until all of the wrinkles were worked out. Wrinkles were frequently smoothed out at the edges of the inner block. A warm, wet rag was used to dampen the piece so that the proper moisture content was maintained. Sometimes it was necessary to remove some staples, hand stretch the piece, smooth out the wrinkles, and re-staple the piece before the inner block was pushed to the maximum depth of 1¼ inches for the recess. After the inner block had reached the maximum depth, the industrial strength staples were in place around the entire outer periphery of the piece.

The fifth step occurred after the piece had been in the molding press for a period of twelve to sixteen hours. The piece was then removed and recut to the exact dimensions of either the standard or the legal size.

The sixth and final step in the recess forming operation was to place the molded piece into a skiving machine, such as the Artisan NP10 Heavy Duty Top Puller and Roller Feed Skiving Machine, to thin out the edges to allow the piece to be assembled with the other pieces to form the finished handbag and to permit the liner material to be sewn along the edges as discussed below.

Leather has a side, from which the hair was removed, i.e., the outer or smooth side, and a side from which the flesh was removed, the inner or rough side. The above process was carried out to mold inner piece 82 shown in FIG. 2 in which a seamless recess was pressed into the rough side of inner piece 82. Similarly, the process was followed to mold outer piece 84 shown in FIG. 2 in which a seamless recess was pressed into its smooth side.

Velcro hook fasteners 30 and 38 are respectively sewn around the sides and bottom of back panel 12 and to recess 18 and the back of purse 20. Adhesive is then applied to the respective rough sides of inner piece 82 and outer piece 84 and the two pieces are joined to form back panel 12.

Liner 74 is sewn to each corner 86 of inner piece 82 and to the edges of inner piece 82 adjacent left side panel 34 and right side panel 32 to form inner pockets 70 and 72 on each side of protuberance 80.

Back panel 12 containing recess 18 and fasteners 30 and 38 are now ready to be respectively sewn to the remaining pieces to form handbag 10 as shown in FIGS. 1–7. Specifically the six (6) major pieces of handbag 10 include: (1) back flap 24 that is lined with a brocade material to which is sewn Velcro loop fasteners 30 and 38, (2) left side panel 34 to which is sewn side outer pocket 50 and patch 68 with triangle 66 and one end of shoulder webbing 60, (3) right side panel 32 to which is sewn patch 68 with triangle 66 and the other end of shoulder webbing 60, (4) closure flap 28 to which tassel 48 is attached, (5) bottom panel 36, back panel 12 with recess 18, and (6) front panel 44. All of the major pieces of handbag 10 and purse 20 are preferably cut from the same type of moldable leather used to mold back panel 12.

Without departing from the spirit and scope of this invention, one of ordinary skill in the art can make various changes and modifications to the device of the present invention to adapt it to various usages and conditions. The present invention can be adapted for use by both ladies and men. As such, these changes and modifications are properly, equitably, and intended to be, within the full range of equivalents of the following claims.

What is claimed is:

1. A handbag comprising a front panel, a back panel, two side panels, an opening, a bottom panel, said back panel having an inner piece, an outer piece, and a recess in the outer piece for receiving a purse and that creates a protuberance having corners within the interior of the handbag, and inner pockets formed in the interior of the handbag by affixing an inner liner to the edges of the inner piece of the back panel and to said corners of the protuberance.

2. The handbag of claim 1 wherein a back flap is affixed to said back panel to at least cover said recess.

3. The handbag of claim 2 wherein said back flap contains fastening means to fasten said back flap to said back panel.

4. The handbag of claim 3 wherein said fastening means comprise Velcro fasteners mounted to said back panel and said back flap.

5. The handbag of claim 3 wherein a purse is within said recess.

6. The handbag of claim 5 wherein said purse is removably fastened within said recess.

7. The handbag of claim 6 wherein said purse is removably fastened within said recess by means of Velcro fasteners.

8. The handbag of claim 1 wherein at least said back panel consists of a type of material suitable for molding.

9. The handbag of claim 8 wherein said recess is molded within said back panel.

10. The handbag of claim 9 wherein said material consists of moldable leather.

11. The handbag of claim 10 wherein said molding is done while said back panel is at a temperature of at least 90° F.

12. The handbag of claim 10 wherein said molding is done after the back panel has soaked in water at a temperature of at least 90° F. for at least 2 minutes.

13. The handbag of claim 10 wherein said back panel comprises the inner piece joined to the outer piece.

14. The handbag of claim 1 wherein at least one side panel has an outer pocket.

15. The handbag of claim 14 wherein said pocket is sized to receive a cell phone.

16. The handbag of claim 1 wherein said recess is sized to receive a cell phone.

17. The handbag of claim 1 wherein shoulder straps are affixed to said side panels.

18. The handbag of claim 17 wherein shoulder straps are adjustable in length.

19. The handbag of claim 1 wherein a closure flap is affixed to said back panel to cover said opening.

20. A handbag comprising a front panel, a back panel, two side panels, a top opening, a closure flap, and a bottom panel, said back panel consisting of a moldable material having an inner piece, an outer piece, and a seamless recess molded in the outer piece for receiving a purse and that creates a protuberance having corners within the interior of the handbag, inner pockets formed in the interior of the handbag by affixing an inner liner to the edges of the inner piece of the back panel and to said corners of the protuberance, a back flap affixed to said back panel adjacent said top opening and at least covering said recess, and fastening means to securely fasten said back flap to said back panel.

21. The handbag of claim 20 wherein at least said back panel consists of leather.

22. The handbag of claim 21 wherein said leather is vegetable tanned.

* * * * *